US010099347B2

(12) United States Patent
Lyons et al.

(10) Patent No.: US 10,099,347 B2
(45) **Date of Patent: *Oct. 16, 2018**

(54) POLYCRYSTALLINE TABLES, POLYCRYSTALLINE ELEMENTS, AND RELATED METHODS

(75) Inventors: Nicholas J. Lyons, Houston, TX (US); Danny E. Scott, Montgomery, TX (US); Anthony A. DiGiovanni, Houston, TX (US); Derek L. Nelms, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 752 days.

This patent is subject to a terminal disclaimer.

(21) Appl. No.: 13/040,921

(22) Filed: Mar. 4, 2011

(65) Prior Publication Data

US 2012/0222364 A1 Sep. 6, 2012

(51) Int. Cl.
*B24D 3/00* (2006.01)
*B24B 1/00* (2006.01)
(Continued)

(52) U.S. Cl.
CPC ..... *B24D 18/0009* (2013.01); *B24D 99/005* (2013.01); *Y10T 428/24996* (2015.04); *Y10T 428/249981* (2015.04)

(58) Field of Classification Search
None
See application file for complete search history.

(56) References Cited

U.S. PATENT DOCUMENTS 4,224,380 A * 9/1980 Bovenkerk et al. ..... 51/307
4,311,490 A 1/1982 Bovenkerk et al.
(Continued)

FOREIGN PATENT DOCUMENTS

EP 1760165 A2 3/2007
EP 2665886 A2 11/2013
(Continued)

OTHER PUBLICATIONS

Scott et al., U.S. Appl. No. 13/010,620 entitled, Polycrystalline Compacts Having Differing Regions Therein, Cutting Elements and Earth-Boring Tools Including Such Compacts, and Methods of Forming Such Compacts, filed Jan. 20, 2011.
(Continued)

*Primary Examiner* — Jennifer A Smith
*Assistant Examiner* — Ross J Christie

(57) ABSTRACT

Polycrystalline elements include a substrate and a polycrystalline table attached to an end of the substrate. The polycrystalline table includes a first region of superabrasive material having a first permeability and at least a second region of superabrasive material having a second, lesser permeability, the at least a second region being interposed between the substrate and the first region. Methods of forming a polycrystalline element involve attaching a polycrystalline table including a first region of superabrasive material having a first permeability and at least a second region of superabrasive material having a second, lesser permeability to an end of a substrate, the at least a second region being interposed between the first region and the substrate. Catalyst material is removed from at least the first region of the polycrystalline table.

20 Claims, 9 Drawing Sheets

(51) Int. Cl.
*B24D 18/00* (2006.01)
*B24D 99/00* (2010.01)

(56) References Cited

U.S. PATENT DOCUMENTS

| | | | | |
|---|---|---|---|---|
| 5,127,923 | A | 7/1992 | Bunting et al. | |
| 5,469,927 | A | 11/1995 | Griffin | |
| 5,954,147 | A | 9/1999 | Overstreet et al. | |
| 7,730,977 | B2 | 6/2010 | Achilles | |
| 7,942,219 | B2 | 5/2011 | Keshavan et al. | |
| 8,020,642 | B2 | 9/2011 | Lancaster et al. | |
| 8,172,012 | B2 | 5/2012 | Achilles | |
| 8,469,121 | B2 | 6/2013 | Lancaster et al. | |
| 2005/0050801 | A1* | 3/2005 | Cho et al. | 51/293 |
| 2005/0115744 | A1* | 6/2005 | Griffin et al. | 175/434 |
| 2005/0210755 | A1* | 9/2005 | Cho et al. | 51/293 |
| 2008/0023231 | A1* | 1/2008 | Vail | 175/434 |
| 2009/0095538 | A1 | 4/2009 | Middlemiss | |
| 2009/0152015 | A1 | 6/2009 | Sani | |
| 2009/0152018 | A1* | 6/2009 | Sani | 175/432 |
| 2010/0181117 | A1* | 7/2010 | Scott | 51/307 |
| 2010/0186304 | A1 | 7/2010 | Burgess et al. | |
| 2010/0192473 | A1* | 8/2010 | Keshavan | 51/307 |
| 2010/0243337 | A1 | 9/2010 | Scott | |
| 2010/0294571 | A1* | 11/2010 | Belnap et al. | 51/307 |
| 2010/0320005 | A1* | 12/2010 | Burhan et al. | 175/426 |
| 2011/0023375 | A1* | 2/2011 | Sani et al. | 51/297 |
| 2011/0036641 | A1 | 2/2011 | Lyons | |
| 2011/0036643 | A1* | 2/2011 | Belnap et al. | 51/307 |
| 2011/0042148 | A1* | 2/2011 | Schmitz et al. | 51/295 |
| 2011/0042149 | A1* | 2/2011 | Scott et al. | 51/309 |
| 2011/0061942 | A1* | 3/2011 | DiGiovanni | 51/309 |
| 2011/0088950 | A1* | 4/2011 | Scott et al. | 51/307 |
| 2012/0186884 | A1 | 7/2012 | Scott et al. | |

FOREIGN PATENT DOCUMENTS

| | | | |
|---|---|---|---|
| GB | 2408735 | A | 6/2005 |
| WO | 2008063568 | A1 | 5/2008 |
| WO | 2011017673 | A2 | 2/2011 |

OTHER PUBLICATIONS

International Search Report for International Application No. PCT/US2012/027071, dated Sep. 3, 2012, 3 pages.
Written Opinion for International Application No. PCT/US2012/027071, dated Sep. 3, 2012, 4 pages.
International Preliminary Report on Patentability for International Application No. PCT/US2012/027071 dated Sep. 10, 2013.
Underwood, E. E., Quantitative Stereology, pp. vii-1, 80-109, Addison-Wesley Publishing Company, Inc., Reading, MA, 1970.
Supplemental European Search Report for International Application No. PCT/US2012/027071 dated Jun. 13, 2014, 9 pages.
International Search Report for International Application No. PCT/US2012/027068 dated Sep. 3, 2012, 3 pages.
International Written Opinion for International Application No. PCT/US2012/027068 dated Sep. 3, 2012, 4 pages.
International Preliminary Report on Patentability for International Application No. PCT/US2012/027068 dated Sep. 10, 2013, 8 pages.
Definition of Space by Merriam-Webster, http://www.merriam-webster.com/dictionary/space retrieved May 6, 2015, 5 pages.
Multimodal distribution, http://en.wikipedia.org/wiki/multimodal_distribution, retrieved May 6, 2015, 15 pages.
Stocks, Ph.D., J.T. (Tim), "Frequency Distributions: Characteristics", Basic Statics Review Unit 1-112—http://msu.edu/user/sw/statrev/strv112.htm, (2003), 7 pages.
Histogram Interpretation: Symmetric and Bimodal 1.3.3.14.4, http://www.itl.nist.gov/div898/handbook/eda/section3/histogr4.htm, retrieved May 6, 2015, 2 pages.
Carreira-Perpinan, Miguel A., "Mode-finding for mixtures of Gaussian distributions", Technical Report CS-99-03, Mar. 31, 1999 (revised Aug. 4, 2000), 23 pages.
Average, http://en.wikipedia.org/wiki/average, retrieved May 6, 2015, 7 pages.
Definition of Average by Merriam-Webster, http://www.merriam-webster.com/dictionary/average, retrieved May 6, 2015, 6 pages.
Definition of Average by Oxford Dictionaries, http://www.oxforddictionaries.com/us/definition/american_english/average, retrieved May 6, 2015, 3 pages.
Chinese Office Action and Search Report for Chinese Application No. 201280018105.9 dated Jan. 21, 2015, 25 pages.

* cited by examiner

POLYCRYSTALLINE TABLES, POLYCRYSTALLINE ELEMENTS, AND RELATED METHODS

FIELD

Embodiments of the present disclosure relate generally to polycrystalline tables, polycrystalline elements, and related methods. Specifically, embodiments of the disclosure relate to polycrystalline elements having polycrystalline tables with a substantially fully leached region and methods of forming such polycrystalline elements.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond compact (often referred to as "PDC") cutting elements, also termed "cutters," which are cutting elements that include a polycrystalline diamond (PCD) material, which may be characterized as a superabrasive or superhard material. Such polycrystalline diamond materials are formed by sintering and bonding together relatively small synthetic, natural, or a combination of synthetic and natural diamond grains or crystals, termed "grit," under conditions of high temperature and high pressure in the presence of a catalyst, such as, for example, cobalt, iron, nickel, or alloys and mixtures thereof, to form a layer of polycrystalline diamond material, also called a diamond table. These processes are often referred to as high temperature/high pressure ("HTHP") processes. The cutting element substrate may comprise a cermet material, i.e., a ceramic-metal composite material, such as, for example, cobalt-cemented tungsten carbide. In some instances, the polycrystalline diamond table may be formed on the cutting element, for example, during the HTHP sintering process. In such instances, cobalt or other catalyst material in the cutting element substrate may be swept into the diamond grains or crystals during sintering and serve as a catalyst material for forming a diamond table from the diamond grains or crystals. Powdered catalyst material may also be mixed with the diamond grains or crystals prior to sintering the grains or crystals together in an HTHP process. In other methods, however, the diamond table may be formed separately from the cutting element substrate and subsequently attached thereto.

To reduce problems associated with differences in thermal expansion and chemical breakdown of the diamond crystals in PDC cutting elements, "thermally stable" polycrystalline diamond compacts (which are also known as thermally stable products or "TSPs") have been developed. Such a thermally stable polycrystalline diamond compact may be formed by leaching catalyst material out from interstitial spaces between the interbonded grains in the diamond table. However, a conventional diamond table may require up to five weeks or even longer to leach substantially all the catalyst material from the interstitial spaces between interbonded grains, slowing down production.

BRIEF SUMMARY

In some embodiments, the disclosure includes polycrystalline elements, comprising a substrate and a polycrystalline table attached to an end of the substrate. The polycrystalline table comprises a first region of superabrasive material having a first permeability and at least a second region of superabrasive material having a second, lesser permeability, the at least a second region being interposed between the substrate and the first region.

In other embodiments, the disclosure includes methods of forming a polycrystalline element, comprising disposing a first plurality of particles comprising a superabrasive material, a second plurality of particles comprising a superabrasive material, a catalyst material, and a third plurality of particles comprising a mass of hard material in a mold. The first and second pluralities of particles are sintered in the presence of the catalyst material and the third plurality of particles is also sintered to form a polycrystalline table having a first region comprising a first permeability and at least a second region comprising a second, lesser permeability attached to a substrate, the at least a second region being interposed between the first region and the substrate. Catalyst material is removed from at least the first region of the polycrystalline table.

In additional embodiments, the disclosure includes methods of forming a polycrystalline element comprising attaching a polycrystalline table comprising a first region of superabrasive material having a first permeability and at least a second region of superabrasive material having a second, lesser permeability to an end of a substrate, the at least a second region being interposed between the first region and the substrate. Catalyst material is removed from at least the first region of the polycrystalline table.

In still further embodiments, the disclosure includes methods of forming a polycrystalline element, comprising forming a first polycrystalline table having a first permeability. The first polycrystalline table is bonded to another polycrystalline table having another, lesser permeability attached to a substrate. Catalyst material is leached from at least the first polycrystalline table.

In other embodiments, the disclosure includes methods of forming a polycrystalline element comprising forming a first polycrystalline table of superabrasive material in the presence of a catalyst material, the first polycrystalline table having a first region having a first permeability and a second region having a second, lower permeability. The catalyst material is at least substantially fully leached from at least the first region of the first polycrystalline table. The first polycrystalline table is bonded to another polycrystalline table of superabrasive material attached to an end of a substrate of hard material, the second region being interposed between the first region and the other polycrystalline table.

BRIEF DESCRIPTION OF THE SEVERAL VIEWS OF THE DRAWINGS

While the specification concludes with claims particularly pointing out and distinctly claiming that which is regarded as the present invention, various features and advantages of embodiments of this invention may be more readily ascertained from the following description of embodiments of the invention when read in conjunction with the accompanying drawings, in which:

DETAILED DESCRIPTION

Figure 1:
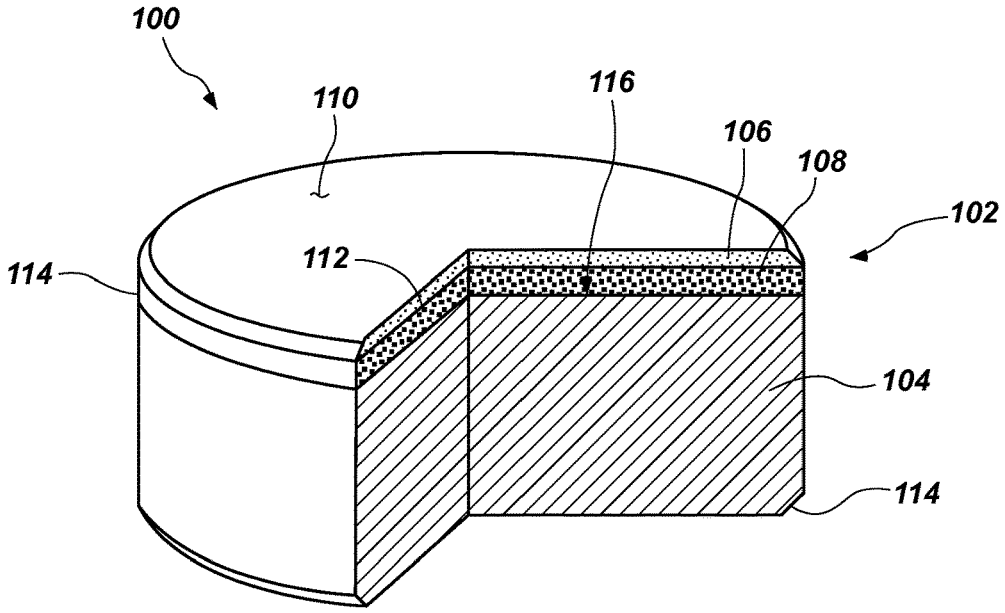
FIG. 1 is a partial cutaway perspective view of a cutting element having a polycrystalline table of the present disclosure.

The illustrations presented herein are not meant to be actual views of any particular earth-boring tool, cutting element, or bearing, but are merely idealized representations that are employed to describe the embodiments of the disclosure. Additionally, elements common between figures may retain the same or similar numerical designation.

The terms "earth-boring tool" and "earth-boring drill bit," as used herein, mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits, and other drilling bits and tools known in the art.

As used herein, the term "superabrasive material" means and includes any material having a Knoop hardness value of about 3,000 $Kg_f/mm^2$ (29,420 MPa) or more. Superabrasive materials include, for example, diamond and cubic boron nitride. Superabrasive materials may also be characterized as "superhard" materials.

As used herein, the term "polycrystalline table" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

As used herein, the terms "nanoparticle" and "nanosized" mean and include any particle, such as, for example, a crystal or grain, having an average particle diameter of between about 1 nm and 500 nm.

The term "green" as used herein means unsintered.

The term "green part" as used herein means an unsintered structure comprising a plurality of discrete particles, which may be held together by a binder material, the unsintered structure having a size and shape allowing the formation of a part or component suitable for use in earth-boring applications from the structure by subsequent manufacturing processes including, but not limited to, machining and densification.

The term "sintering" as used herein means temperature driven mass transport, which may include densification and/or coarsening of a particulate component, and typically involves removal of at least a portion of the pores between the starting particles (accompanied by shrinkage) combined with coalescence and bonding between adjacent particles.

As used herein, the term "material composition" means the chemical composition and microstructure of a material. In other words, materials having the same chemical composition but a different microstructure are considered to having different material compositions.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Referring to FIG. 1, a partial cutaway perspective view of a cutting element 100 is shown. The cutting element 100 includes a polycrystalline table 102 attached on an end of a substrate 104. The polycrystalline table 102 may comprise a disc attached on an end of the cylindrical substrate 104 at a planar substrate interface 116. The polycrystalline table 102 includes a first region 106 and at least a second region 108. The first region 106 may comprise a layer including a cutting face 110 of the polycrystalline table 102 and extending toward the substrate 104. The second region 108 may be interposed between the first region 106 and the substrate 104. An interface 112 may lie at the boundary between the first region 106 and the second region 108. Chamfers 114 may be formed at the peripheral edges of the polycrystalline table 102, the substrate 104, or both.

The polycrystalline table 102 may comprise a polycrystalline superabrasive material. For example, the polycrystalline table 102 may comprise natural diamond, synthetic diamond, a combination of natural and synthetic diamond, cubic boron nitride, carbon nitrides, and other superabrasive materials known in the art. Individual grains of the superabrasive material may be interbonded, such as, for example, by diamond-to-diamond bonding, to form a three-dimensional polycrystalline structure. A catalyst material for catalyzing formation of the inter-granular bonds of the polycrystalline material may comprise, for example, Group VIIIB metals such as cobalt, iron, nickel, or alloys and mixtures thereof.

The substrate 104 may comprise a hard material. For example, the hard material may comprise a ceramic-metal composite material (i.e., a "cermet" material) comprising a plurality of hard ceramic particles dispersed throughout a metal matrix material. The hard ceramic particles may comprise carbides, nitrides, oxides, and borides (including boron carbide ($B_4C$)). More specifically, the hard ceramic particles may comprise carbides and borides made from elements such as W, Ti, Mo, Nb, V, Hf, Ta, Cr, Zr, Al, and Si. By way of example and not limitation, materials that may be used to form hard ceramic particles include tungsten carbide, titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). The metal matrix material of the ceramic-metal composite material may include, for example, cobalt-based, iron-based, nickel-based, iron- and nickel-based, cobalt- and nickel-based, and iron- and cobalt-based alloys. The matrix material may also be selected from commercially pure elements such as cobalt, iron, and nickel. For example, the hard material may comprise a plurality of tungsten carbide particles in a cobalt matrix, known in the art as cobalt-cemented tungsten carbide.

Figure 2:
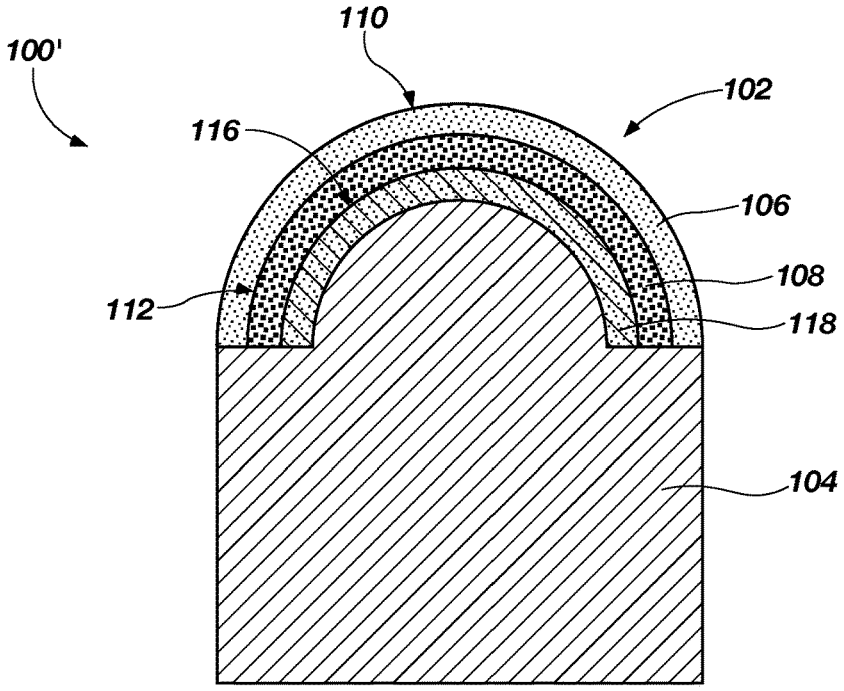
FIG. 2 illustrates a cross-sectional side view of another cutting element having a dome-shaped polycrystalline table of the present disclosure.

Referring to FIG. 2, a cross-sectional side view of another cutting element 100' is shown. The cutting element 100' includes a polycrystalline table 102 attached on an end of a substrate 104. The polycrystalline table 102 may comprise a hollow dome shape, the substrate 104 including a dome-shaped protrusion forming a dome-shaped interface 116 to which the polycrystalline table 102 is attached. In other embodiments, the polycrystalline table 102 may comprise a solid dome shape, such as, for example, a hemisphere, attached to the polycrystalline table 102 at a planar substrate interface 116. In still other embodiments, the polycrystalline table 102 may comprise other shapes, such as, for example, chisel-shaped, tombstone-shaped, or other shapes and configurations for the cutting face 110 as known in the art. The polycrystalline table 102 includes a first region 106 and at least a second region 108. The first region 106 may comprise a dome-shaped layer including a cutting face 110 of the polycrystalline table 102 and extending toward the substrate 104. The second region 108 may be interposed between the first region 106 and the substrate 104. The substrate 104 may include an intermediate layer 118. The intermediate layer 118 may comprise a combination of the superabrasive material of the polycrystalline table 102 and the hard material of the remainder of the substrate 104. Concentrations of the superabrasive material and the hard material may comprise a gradient of varying percentages of the superabrasive material and the hard material through a depth of the intermediate layer 118 to provide a transition between the polycrystalline table 102 and the substrate 104. Thus, the intermediate layer 118 may enable a stronger attachment between the polycrystalline table and the substrate.

Figure 3:
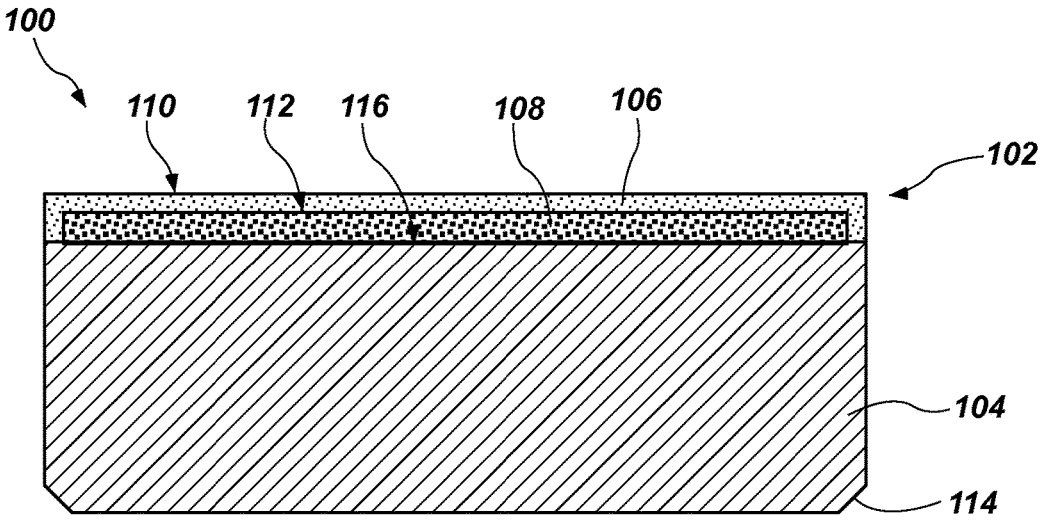
FIG. 3 is a cross-sectional side view of a further cutting element having another polycrystalline table configuration of the present disclosure.

Referring to FIG. 3, a cross-sectional side view of another cutting element 100 is shown. The cutting element 100 includes a polycrystalline table 102 attached on an end of a substrate 104. The polycrystalline table 102 may comprise a first region 106 and at least a second region 108. The first region 106 may extend from a cutting face 110 of the polycrystalline table 102 toward the substrate 104 and having an annular extension extending toward the substrate 104 at the periphery of the polycrystalline table 102. The annular extension may abut the substrate 104 at a portion of the substrate interface 116. Thus, the second region 108 may not extend to the periphery of the polycrystalline table 102, the annular extension of the first region 106 surrounding the second region 108 at the radially outer portion thereof. The second region 108 may be interposed between the first region 106 and the substrate 104.

Figure 4:
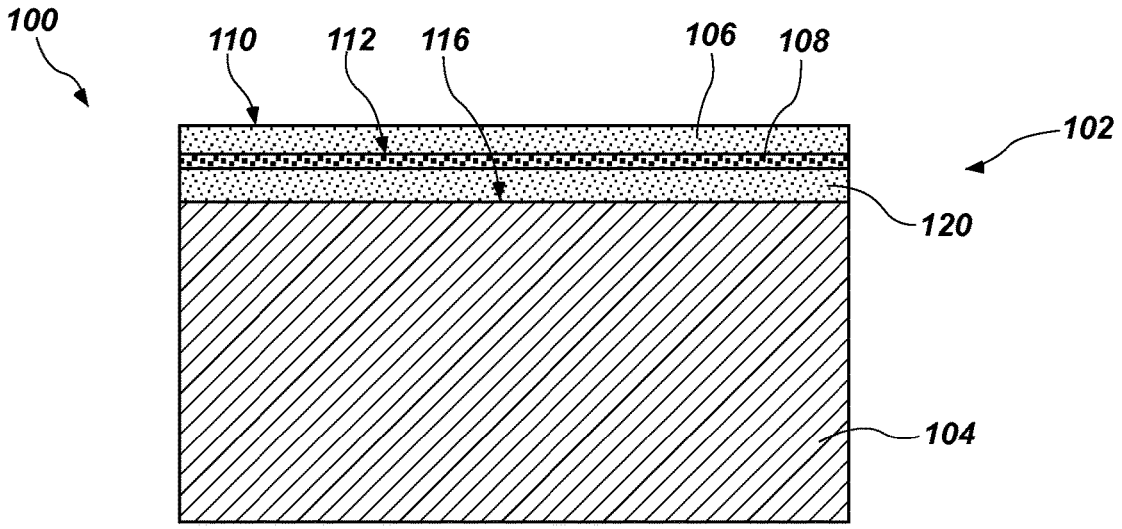
FIG. 4 depicts a cross-sectional side view of a cutting element having a further polycrystalline table configuration of the present disclosure.

Referring to FIG. 4, a cross-sectional side view of another cutting element 100 is shown. The cutting element 100 includes a polycrystalline table 102 attached on an end of a substrate 104. The polycrystalline table 102 may comprise a first region 106, a second region 108, and a third region 120. The first region 106 may extend from a cutting face 110 of the polycrystalline table 102 toward the substrate to an interface 112 with the second region 108. The second region 108 may be interposed between the first region 106 and the third region 120. The third region 120 may extend from the second region 108 to the substrate interface 116 where the polycrystalline table 102 is attached to the substrate 104. Thus, the third region 120 may be disposed adjacent the second region 108 on an end opposing the first region 106.

Figure 5:
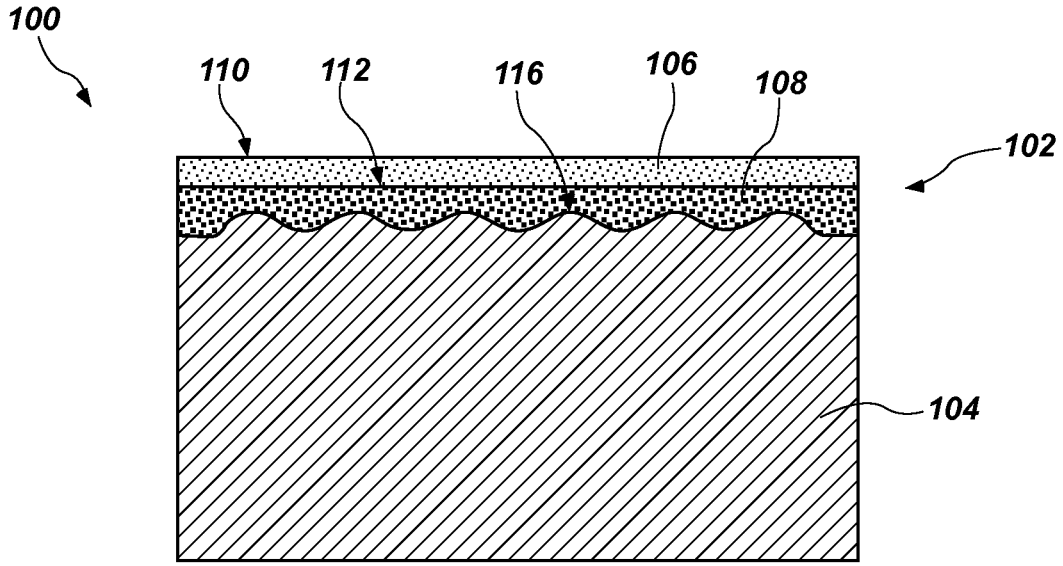
FIG. 5 illustrates a cross-sectional side view of a cutting element having a polycrystalline table of the present disclosure with a non-planar interface design at an interface between the polycrystalline table and a substrate.

Referring to FIG. 5, a cross-sectional side view of another cutting element 100 is shown. The cutting element 100 includes a polycrystalline table 102 attached on an end of a substrate 104. The polycrystalline table 102 includes a first region 106 and at least a second region 108. The second region 108 may be interposed between the first region 106 and the substrate 104. A substrate interface 116 between the polycrystalline table 102 and the substrate 104 may comprise a non-planar interface design. For example, the non-planar interface design may comprise a series of alternating protrusions and recesses, concentric annular rings, radially extending spokes, or other non-planar interface designs known in the art.

Figure 6:
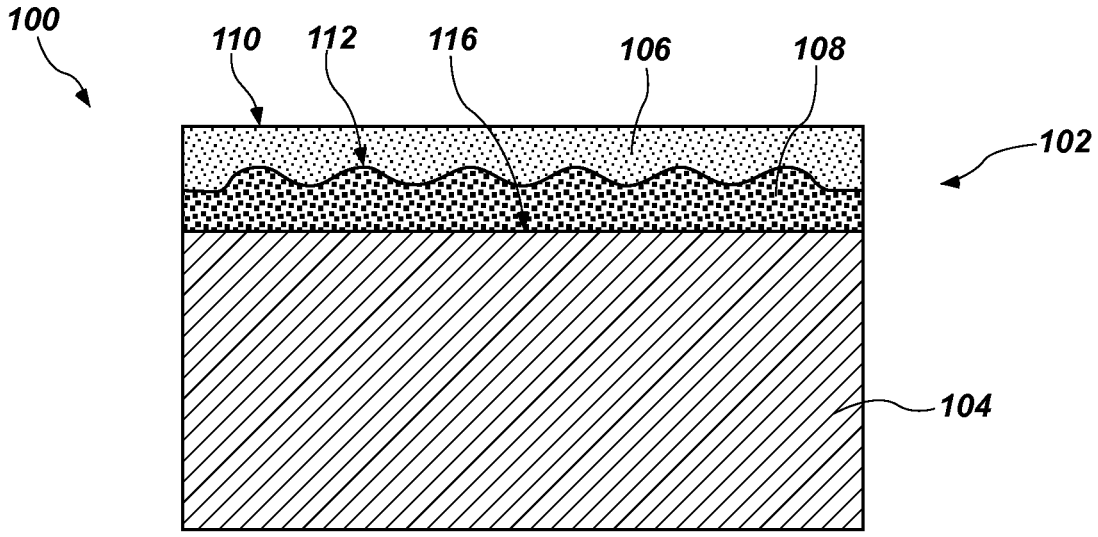
FIG. 6 illustrates a cross-sectional side view of a cutting element having a polycrystalline table of the present disclosure with a non-planar interface design at an interface between regions of the polycrystalline table.
Figure 7A:
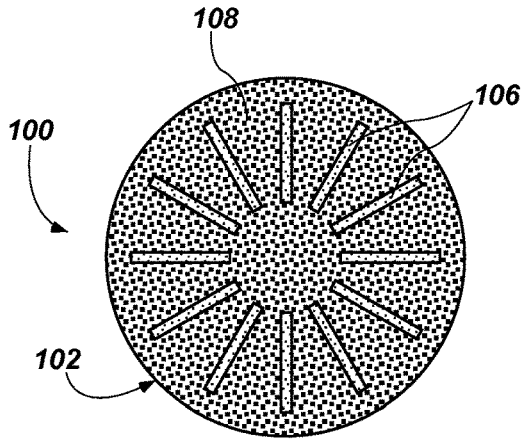
FIGS. 7A through 7F are cross-sectional top views of interface designs for polycrystalline tables of the present disclosure.
Figure 7B:
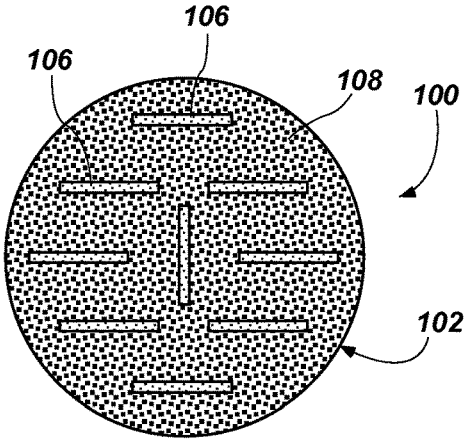
Figure 7C:
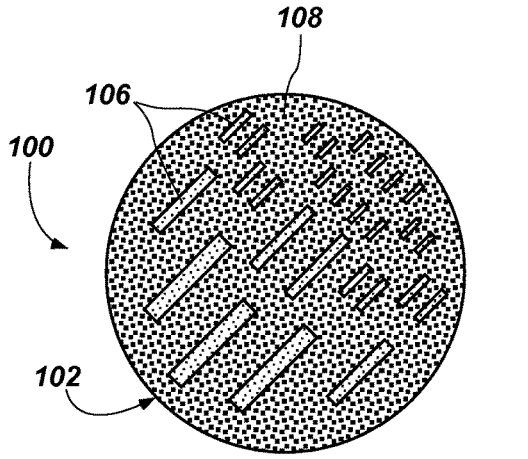
Figure 7D:
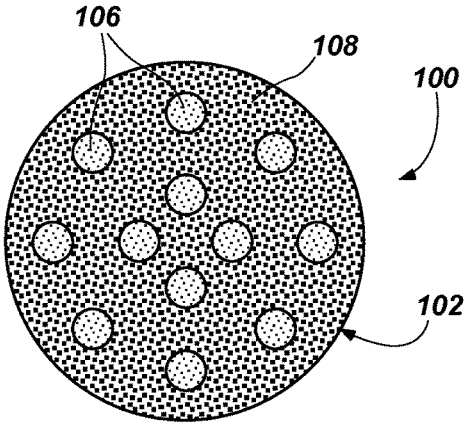
Figure 7E:
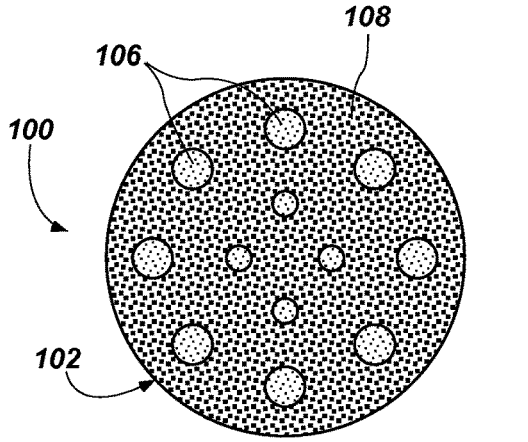
Figure 7F:
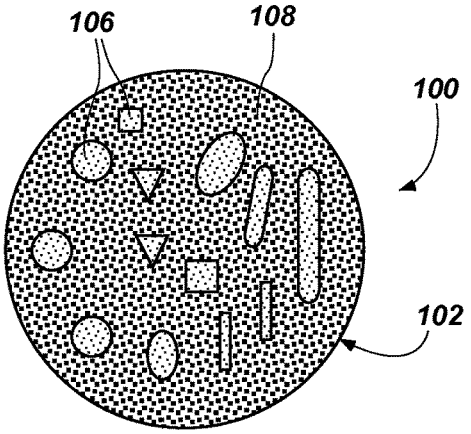

Referring to FIG. 6, a cross-sectional side view of another cutting element 100 is shown. The cutting element 100 includes a polycrystalline table 102 attached on an end of a substrate 104. The polycrystalline table 102 includes a first region 106 and at least a second region 108. The second region 108 may be interposed between the first region 106 and the substrate 104. An interface 112 between the first region 106 and the second region 108 may comprise a non-planar interface design. For example, the non-planar interface design may comprise a series of alternating protrusions and recesses, concentric annular rings, radially extending spokes, or other non-planar interface designs known in the art. In embodiments where both the interface 112 between the first region 106 and the second region 108 and the substrate interface 116 between the polycrystalline table 102 and the substrate 104 comprise non-planar interface designs, the non-planar interface design located at the interface 112 between the first region 106 and the second region 108 may be at least substantially the same as the non-planar interface design located at the substrate interface 116 between the polycrystalline table 102 and the substrate 104. Alternatively, the non-planar interface design located at the interface 112 between the first region 106 and the second region 108 may be different from the non-planar interface design located at the substrate interface 116 between the polycrystalline table 102 and the substrate 104. As a specific, non-limiting example, the non-planar interface design located at the interface 112 between the first region 106 and the second region 108 may comprise concentric rings, and the non-planar interface design located at the substrate interface 116 between the polycrystalline table 102 and the substrate 104 may comprise radially extending spokes.

Referring to FIGS. 7A through 7F, cross-sectional top views of cutting elements 100 are shown. The cross-sections shown are taken within the polycrystalline table 102 and depict portions of the first region 106 and the second region 108. As shown, the polycrystalline table 102 may comprise a non-planar interface design between the first region 106 and the second region 108. Similar non-planar interface designs may also be disposed at the substrate interface 116 (see FIG. 5) between the polycrystalline table 102 and the substrate 104. It is noted, however, that the boundaries between the first region 106 and the second region 108 may not be as clear as illustrated in FIGS. 5 through 7F because the first region 106 and the second region 108 may comprise grains of the same superabrasive material in varying sizes and because some shifting, crushing, fracturing, and growth of the grains may occur during formation of the polycrystalline table 102. Thus, the shapes and designs shown are meant as simplified examples for illustrative purposes.

In each of the embodiments shown in FIGS. 1 through 7F, a first region 106 of a polycrystalline table 102 may comprise a polycrystalline region of a first permeability. A second region 108 in each of the embodiments shown in FIGS. 1 through 7F may comprise a polycrystalline region of a second, lesser permeability. The first region 106 may be at least substantially fully leached of catalyst material. Thus, the first region 106 may be at least substantially free of catalyst material that may otherwise remain in interstitial spaces among interbonded grains of superabrasive material after formation of a polycrystalline table 102. When it is said that the interstitial spaces between the interbonded grains of superabrasive material in the first region 106 of the polycrystalline table 102 may be at least substantially free of catalyst material, it is meant that catalyst material is removed from the open, interconnected network of spatial regions among the grains within the microstructure of the first region 106, although a relatively small amount of catalyst material may remain in closed, isolated spatial regions between the grains, as a leaching agent may not be able to reach volumes of catalyst material within such closed, isolated spatial regions. The differences in permeability between the first region 106 and the second region 108 (i.e., the second region 108 having a reduced permeability compared to the first region 106) may enable catalyst material to be removed from the first region 106 relatively quickly as compared to removing catalyst material from the second region 108.

The second region 108 may have a lesser permeability than the first region 106 because the second region 108 comprises a volume percentage of superabrasive material that is greater than the volume percentage of superabrasive material of the first region 106. For example, the polycrystalline table 102 may be formed having a microstructure as described in U.S. patent application Ser. No. 13/010,620, filed Jan. 20, 2011 on behalf of Scott et al. As a non-limiting example, the first region 106 may comprise less than or equal to 91% by volume of the superabrasive material, while the second region 108 may comprise greater than or equal to 92% by volume of the superabrasive material. As a specific, non-limiting example, the first region 106 may comprise about 85% to about 95% by volume of the superabrasive material and the second region 108 may, in turn, comprise about 96% to about 99% by volume of the superabrasive material. Thus, the second region 108 may comprise a correspondingly smaller volume percentage of interstitial spaces among interbonded grains of superabrasive material as compared to the volume percentage of interstitial spaces among interbonded grains of superabrasive material of the first region 106. Where the second region 108 comprises a higher volume percentage of superabrasive material, there may be fewer and smaller interconnected spaces among interbonded grains of superabrasive material and, therefore, fewer and more constricted paths for a leaching agent to penetrate.

The second region 108 may have a lesser permeability than the first region 106 because the second region 108 may comprise a smaller average grain size of grains of superabrasive material than the average grain size of grains of superabrasive material of the first region 106. For example, grains of the second region 108 may comprise an average grain size that is 50 to 150 times smaller than the average grain size of grains of the first region 106. As a further example, the first region 106 may comprise grains having an average grain size of at least 5 μm, and the second region 108 may comprise grains having an average grain size of less than 1 μm. As specific, non-limiting examples, the first region 106 may comprise grains having an average grain size of between about 3 μm and about 40 μm, and the second region 108 may comprise a mixture of grains, at least some of which have average grain sizes of 500 nm, 200 nm, 150 nm, and even as small as 6 nm. Larger grains may be interspersed among the nano-sized grains (i.e., grains having an average particle diameter of between 1 nm and 500 nm). Where the second region 108 comprises a smaller average grain size of grains of superabrasive material, there may be fewer and smaller interconnected spaces among the interbonded grains and, therefore, fewer and more constricted paths for a leaching agent to penetrate. In some embodiments, at least some of the grains of superabrasive material of the second region 108 may comprise nano-sized grains (i.e., grains having a diameter less than about 500 nm). In addition, the use of a multi-modal size distribution of grains in the second region 108 may result in fewer and smaller interconnected spaces among the interbonded grains of superabrasive material.

Further, the second region 108 may have a lesser permeability than the first region 106 because the second region 108 may comprise interstitial spaces having a lesser interconnectivity as compared to the interconnectivity of the interstitial spaces of the first region 108. For example, the mean free path within the interstitial spaces between the interbonded grains in the first region 106 may be about 10% or greater, about 25% or greater, or even about 50% or greater than the mean free path within the interstitial spaces between the interbonded grains in the second region 108. Theoretically, the mean free path within the interstitial spaces between the interbonded grains in the first region 106 and the mean free path within the interstitial spaces between the interbonded grains in the second region 108 may be determined using techniques known in the art, such as those set forth in Ervin E. Underwood, Quantitative Stereology, (Addison-Wesley Publishing Company, Inc. 1970), which is incorporated herein in its entirety by this reference.

Figure 8:
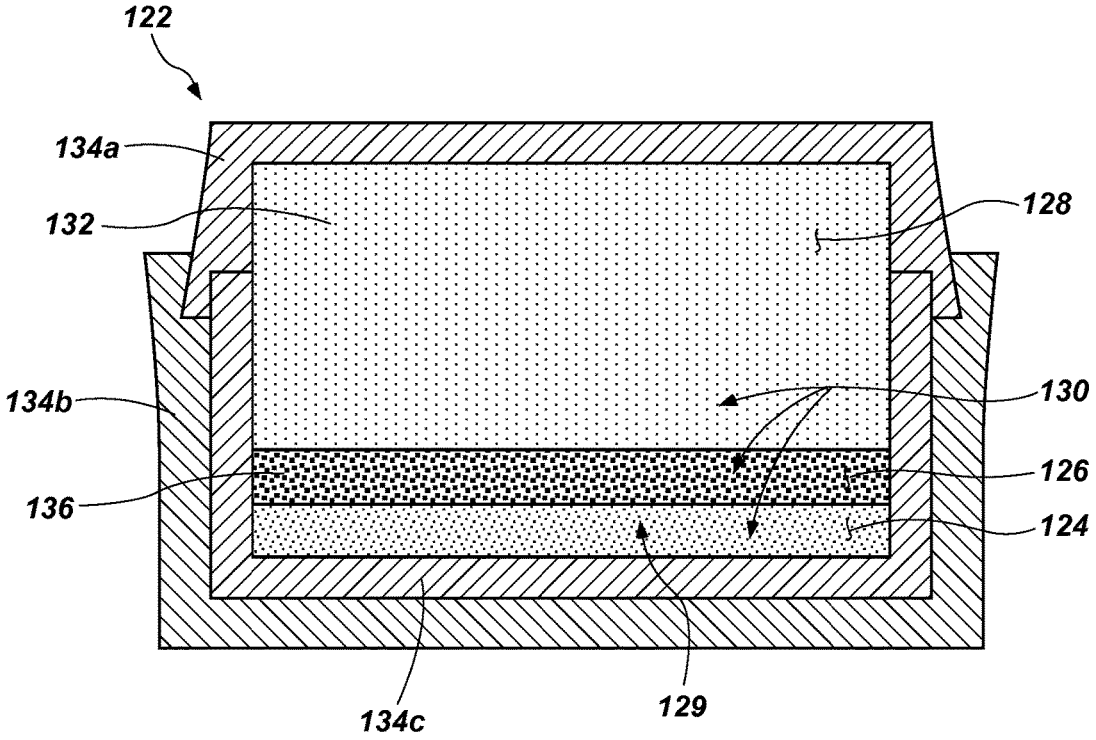
FIG. 8 depicts a cross-sectional view of a mold in a process for forming a polycrystalline table of the present disclosure.

Referring to FIG. 8, a cross-sectional view of a mold 122 in a process for forming a polycrystalline table 102 is shown. A first plurality of particles 124 comprising a superabrasive material may be disposed in the mold 122. A second plurality of particles 126 comprising a superabrasive material may also be disposed in the mold 122 adjacent the first plurality of particles 124. A third plurality of particles 128 comprising a mass of hard material may optionally be disposed in the mold 122, the second plurality of particles 126 being interposed between the first plurality of particles 124 and the third plurality of particles 128.

Particles of the second plurality of particles 126 may have a multi-modal (e.g., bi-modal, tri-modal, etc.) particle size distribution. For example, the second plurality of particles 126 may include particles having a first average particle size, and particles having a second average particle size that differs from the first average particle size in an unbonded state. The unbonded second plurality of particles 126 may comprise particles having relative and actual sizes as previously described with reference to the second region 108 of the polycrystalline table 102, although it is noted that some degree of grain growth and/or shrinkage may occur during the sintering process used to form the polycrystalline table 102.

Particles of the first plurality of particles 124 may have a mono-modal particle size distribution in some embodiments. In other embodiments, however, particles of the first plurality of particles 124 may have a multi-modal (e.g., bi-modal, tri-modal, etc.) particle size distribution. In such embodiments, however, the average grain size of each mode may be about 1 μm or greater. In other words, particles of the first plurality of particles 124 may be free of nanoparticles of the superabrasive material. The unbonded first plurality of particles 124 may comprise particles having relative and actual sizes as previously described with reference to grains of the first region 106 of the polycrystalline table 102, although it is noted that some degree of grain growth and/or shrinkage may occur during the sintering process used to form the polycrystalline table 102, as previously mentioned.

The first plurality of particles 124 may comprise a first packing density, and the second plurality of particles 126 may comprise a second, greater packing density in the mold 122 when in an unbonded state. For example, the second plurality of particles 126 may comprise a multi-modal particle size distribution, enabling the particles 126 to pack more densely. By contrast, the first plurality of particles 124 may comprise, for example, a mono-modal particle size distribution that packs less densely than the second plurality of particles 126.

A catalyst material 130, which may be used to catalyze formation of inter-granular bonds among particles of the first and second pluralities of particles 124 and 126 at a lesser temperature and pressure than might otherwise be required, may also be disposed in the mold 122. The catalyst material may comprise catalyst powder dispersed among at least the third plurality of particles 128, and optionally among the first and second pluralities of particles 124 and 126. In some embodiments, catalyst powder may be provided within the second plurality of particles 126, but not in the first plurality of particles 124, and the catalyst material 130 may be swept into the first plurality of particles 124 from among the second plurality of particles 126. It may be desirable to disperse catalyst powder among the first plurality of particles 124, as the rate of flow of molten catalyst material 130 through the second plurality of particles 126 during the sintering process may be relatively slow due to the reduced permeability of the polycrystalline material formed therefrom, and the relatively small and dispersed interstitial spaces among the particles of the second plurality of particles 126 through which the catalyst material 130 may flow. However, catalyst material may sweep among the first plurality of particles 124 before bonding among the particles occurs, and may, therefore, flow among the particles at a rate sufficient to ensure adequate sintering of the first plurality of particles. The catalyst material 130 may comprise a catalyst foil or disc interposed between the third plurality of particles 128 and the second plurality of particles 126 or between the second plurality of particles 126 and the first plurality of particles 124. Further, the catalyst material 130 may be coated on at least some particles of the second plurality of particles 126. For example, at least some particles of the second plurality of particles 126 may be coated with the catalyst material 130 using a chemical solution deposition process, commonly known in the art as a sol-gel coating process. The third plurality of particles 128 may be fully sintered to form a substrate 104 having a final density before being placed in the mold 122. The second plurality of particles 126 may be pressed with catalyst material 130 (e.g., in the foam of a catalyst powder) to form a green second region 136 of a polycrystalline table 102. During this pressing, a non-planar interface design, such as, for example, the non-planar interface designs discussed previously in connection with FIGS. 5 through 7F, may be imparted to a green substrate 132, the green second region 136, or both.

In some embodiments, catalyst material 130 in the form of catalyst powder that is dispersed among either the first plurality of particles 124 or the second plurality of particles 126 may have an average particle size of between about 10 nm and about 1 μm. Further, it may be desirable to select the average particle size of the catalyst powder such that a ratio of the average particle size of the catalyst powder to the average particle size of the particles with which the catalyst powder is mixed is within the range of from about 1:10 to about 1:1000, or even within the range from about 1:100 to about 1:1000, as disclosed in U.S. Patent Application Publication No. US 2010/0186,304 A1, which published Jul. 29, 2010 in the name of Burgess et al., and is incorporated herein in its entirety by this reference. Particles of catalyst material 130 may be mixed with the first, second, or third pluralities of particles 124, 126, and 128 using techniques known in the art, such as standard milling techniques, by forming and mixing a slurry that includes the particles of catalyst material 130 and the first, second, or third pluralities of particles 124, 126, and 128 in a liquid solvent, and subsequently drying the slurry, etc.

An optional fourth plurality of particles 129 may also be disposed in the mold 122. The fourth plurality of particles 129 may be dispersed among the first plurality of particles 124. The fourth plurality of particles 129 may comprise a non-catalyst material that is removable using a leaching agent, such as, for example, gallium, indium, or tungsten. Admixture of the fourth plurality of particles 129 among the first plurality of particles 124 may enable the second plurality of particles 126 to have a greater packing density than the first plurality of particles 124.

The mold 122 may include one or more generally cup-shaped members, such as the cup-shaped member 134*a*, the cup-shaped member 134*b*, and the cup-shaped member 134*c*, which may be assembled and swaged and/or welded together to form the mold 122. The first, second, and third pluralities of particles 124, 126, and 128 and the catalyst material 130 may be disposed within the inner cup-shaped member 134*c*, as shown in FIG. 8, which has a circular end wall and a generally cylindrical lateral side wall extending perpendicularly from the circular end wall, such that the inner cup-shaped member 134*c* is generally cylindrical and includes a first closed end and a second, opposite open end.

After providing the first plurality of particles 124, the second plurality of particles 126, and the optional third and fourth pluralities of particles 128 and 129 in the mold 122, the assembly optionally may be subjected to a cold pressing process to compact the first plurality of particles 124, the second plurality of particles 126, and the optional third and fourth pluralities of particles 128 and 129 in the mold 122.

In embodiments where the optional third plurality of particles 128 comprising a hard material is present in the form of a fully sintered substrate, the first, second, and optional fourth pluralities of particles 124, 126, and 129 may simply be compacted against the third plurality of particles 128.

The resulting assembly then may be sintered in an HTHP process in accordance with procedures known in the art to form a cutting element 100 having polycrystalline table 102 comprising a superabrasive polycrystalline material including a first region 106 and a second region 108, generally as previously described with reference to FIGS. 1 through 6. Referring to FIGS. 1 and 8 together, the first plurality of particles 124 (FIG. 8) may form a first region 106 of the polycrystalline table 102 (FIG. 2), and the second plurality of particles 126 (FIG. 8) may form a second region 108 of the polycrystalline table 102 (FIG. 2).

Although the exact operating parameters of HTHP processes will vary depending on the particular compositions and quantities of the various materials being sintered, the pressures in the heated press may be greater than about 5.0 GPa and the temperatures may be greater than about 1,400° C. In some embodiments, the pressures in the heated press may be greater than about 6.5 GPa (e.g., about 6.7 GPa). Furthermore, the materials being sintered may be held at such temperatures and pressures for a time period between about 30 seconds and about 20 minutes.

Figure 9:
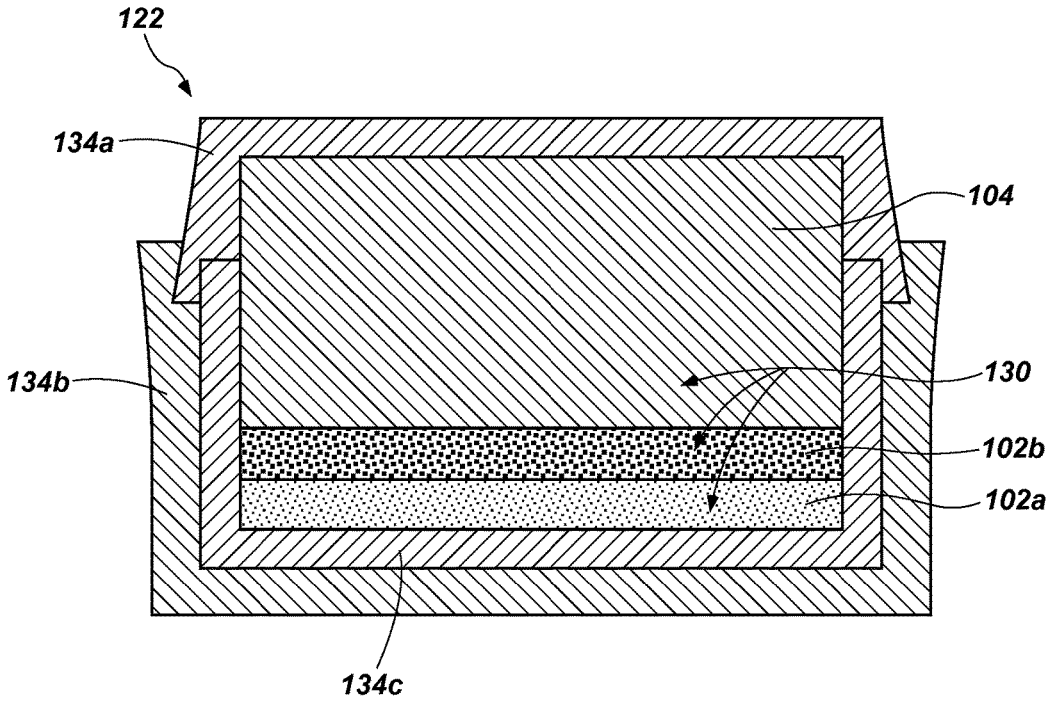
FIG. 9 illustrates a cross-sectional view of a mold in another process for forming a polycrystalline table of the present disclosure.

Referring to FIG. 9, a cross-sectional view of a mold 122 in another process for forming a polycrystalline table 102 is shown. Disposed in the mold 122 is a separately formed polycrystalline table 102*a* having a first permeability. Another polycrystalline table 102*b* having a second, lesser permeability attached on an end of a substrate 104 is also disposed in the mold. The separately formed polycrystalline table 102*a*, the other polycrystalline table 102*b*, and the substrate 104 may be subjected to a sintering process, such as, for example, an HTHP process as has been described previously, in the mold 122. The separately formed polycrystalline table 102*a* and the other polycrystalline table 102*b* may be sintered in the presence of catalyst material 130. For example, catalyst material 130 may remain in interstitial spaces between interbonded grains of superabrasive material after the original sintering process used to foam the separately formed and the other polycrystalline tables 102*a* and 102*b*. In some embodiments, however, the separately formed polycrystalline table 102*a* may be at least partially leached to remove at least some catalyst material 130 therefrom prior to disposing it in the mold 122 adjacent the other polycrystalline table 102*b*. Alternatively or in addition to catalyst material 130 already present, catalyst material 130 may be provided in the form of a disc or foil interposed between the separately formed and the other polycrystalline tables 102*a* and 102*b*. Thus, the separately formed polycrystalline table 102*a* may have a first permeability and may be used to form a first region 106 having a first permeability within a resulting polycrystalline table 102. Likewise, the other polycrystalline table 102*b* may have a second, lower permeability and may be used to form a second region 108 having a second, lower permeability within the resulting polycrystalline table 102.

Figure 10:
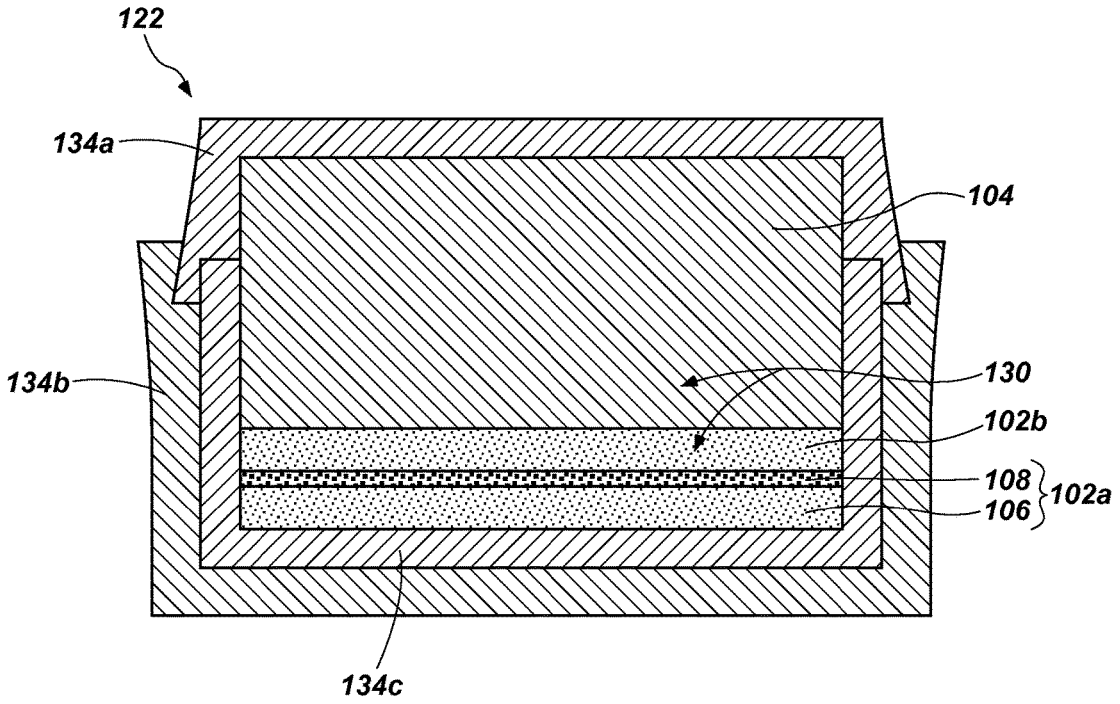
FIG. 10 shows a cross-sectional view of a mold in another process for forming a polycrystalline table of the present disclosure.

Referring to FIG. 10, a cross-sectional view of a mold 122 in another process for forming a polycrystalline table 102 is shown. Disposed in the mold 122 is a separately formed polycrystalline table 102*a*. The separately formed polycrystalline table 102*a* may comprise a first region 106 having a first permeability and a second region 108 having a second, lower permeability. The separately formed polycrystalline table 102*a* may be disposed on another polycrystalline table 102*b* with the second region 108 interposed between the first region 106 and the other polycrystalline table 102*b*. The separately formed polycrystalline table 102*a* may be at least substantially fully leached prior to being disposed in the mold 122. During sintering, the second region 108 may impede flow of the catalyst material 130 from the substrate 104 and the other polycrystalline table 102*b* into the separately formed polycrystalline table 102*a*. Thus, the first region 106 may remain at least substantially fully free of catalyst material 130 without requiring subsequent leaching or requiring less subsequent leaching. In such embodiments, the resulting polycrystalline table 102 may particularly resemble that shown in FIG. 4. In other embodiments, the separately formed polycrystalline table 102*a* may not be at least substantially fully leached, and catalyst material 130 may remain in the first and second regions 106 and 108 within the separately formed polycrystalline table 102*a*.

Using the processes described in relation to FIGS. 8 and 9, a polycrystalline table 102 comprising a first region 106 having a first permeability and at least a second region 108 having a second, lesser permeability may be attached on an end of a substrate 104. The polycrystalline table 102 may then be subjected to a leaching process to substantially fully remove catalyst material 130 from at least the first region 106 therein. Thus, a cutting element 100, as shown in any of FIGS. 1 through 7F, may be formed.

Figure 11:
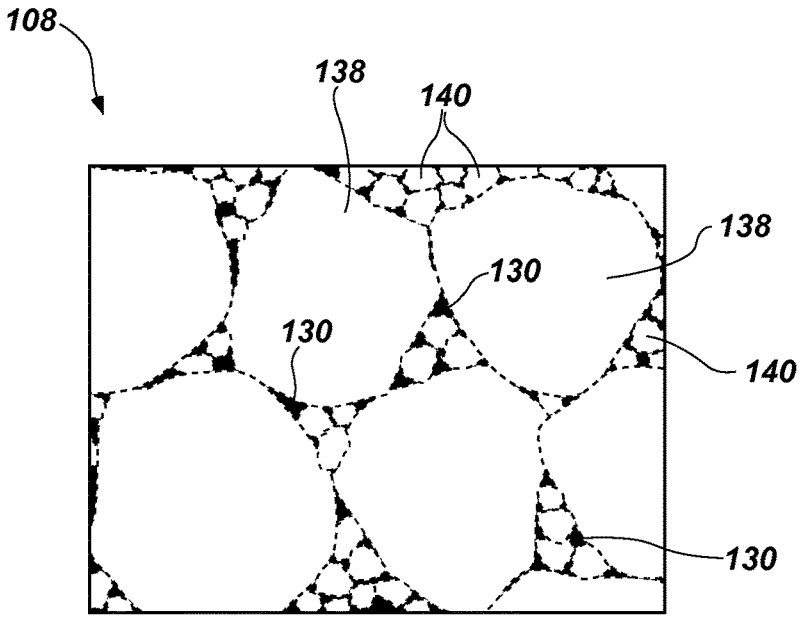
FIG. 11 is a simplified cross-sectional view of a region of a polycrystalline table of the present disclosure.

Referring to FIG. 11, a simplified cross-sectional view is shown of how a second region 108 of a polycrystalline table 102 formed by the foregoing methods may appear under magnification. The second region 108 may comprise a multi-modal grain size distribution, there being larger grains 138 of superabrasive material and smaller grains 140 of superabrasive material. The smaller grains 140 may comprise nano-sized grains. The larger grains 138 and the smaller grains 140 may be interbonded to form a polycrystalline material. Catalyst material 130 may be disposed in the interstitial spaces among interbonded grains 138 and 140 of superabrasive material. Thus, the second region 108 may comprise a volume percentage of catalyst material 130 disposed in interstitial spaces among interbonded grains 138 and 140 of superabrasive material.

Figure 12:
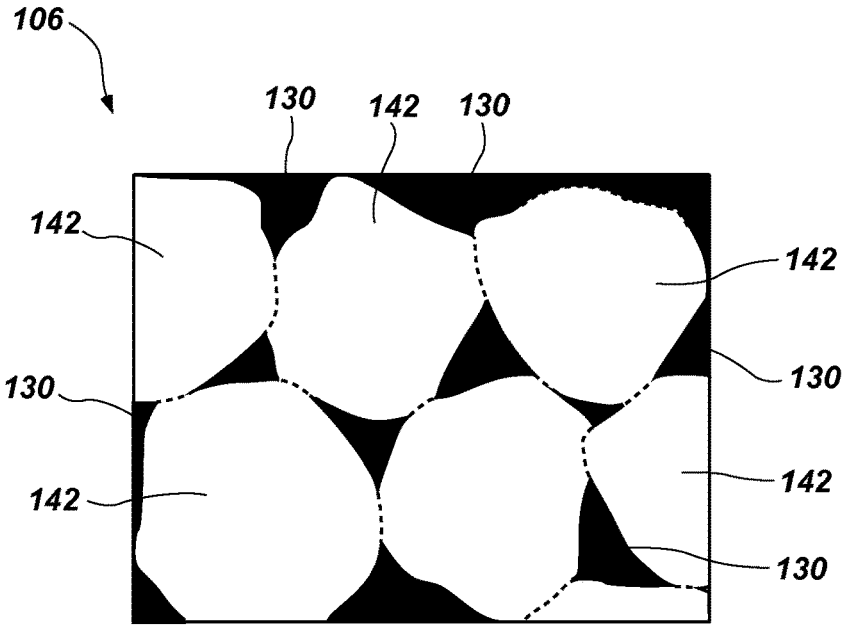
FIG. 12 illustrates a simplified cross-sectional view of another region of a polycrystalline table of the present disclosure.

Referring to FIG. 12, a simplified cross-sectional view is shown of how a first region 106 of a polycrystalline table 102 formed by the foregoing methods may appear under magnification prior to being subjected to a leaching process. The first region 106 may comprise a mono-modal grain size distribution, there being grains 142 having a size clustered about a single average grain size. The first region 106 may be devoid of nano-sized grains. The grains 142 may be interbonded to form a polycrystalline material. Catalyst material 130 may be disposed in the interstitial spaced among interbonded grains 142 of superabrasive material. Thus, the first region 106 may comprise a volume percentage of catalyst material 130 disposed in interstitial spaces among interbonded grains 142 of superabrasive material. Comparing the microstructure shown in FIG. 11 to that shown in FIG. 12, the volume percentage of catalyst material 130 disposed in interstitial spaces among interbonded grains 138 and 140 of superabrasive material within the second region 108 may be smaller than the volume percentage of catalyst material 130 disposed in interstitial spaces among interbonded grains 142 of superabrasive material within the first region 106.

Figure 13:
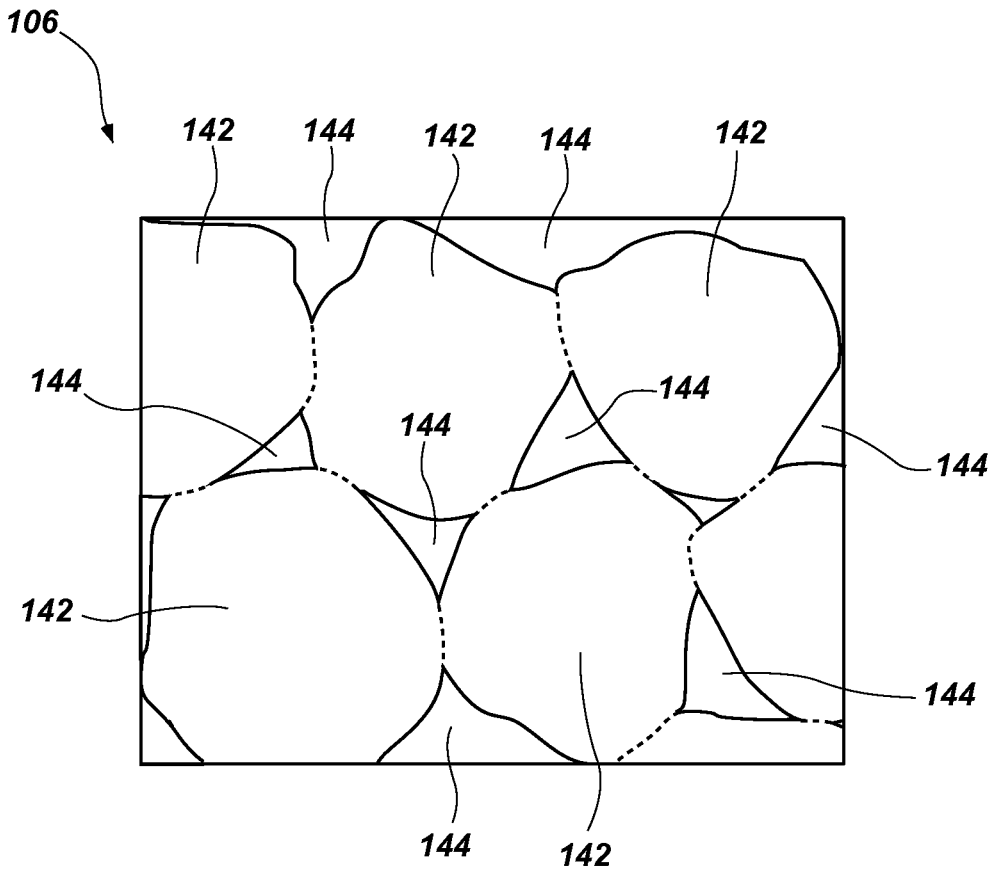
FIG. 13 is a simplified cross-sectional view of the region shown in FIG. 12 after a leaching process.

Referring to FIG. 13, a simplified cross-sectional view is shown of how the first region 106 is shown in FIG. 12 after being subjected to a leaching process. Specifically, as known in the art and described more fully in U.S. Pat. Nos.

5,127,923 and 4,224,380, which are incorporated herein in their entirety by this reference, aqua regia (a mixture of concentrated nitric acid ($HNO_3$) and concentrated hydrochloric acid (HCl)) may be used to at least substantially remove catalyst material 130 from the interstitial spaces among the grains 142 in the first region 106 of the polycrystalline table 102. It is also known to use boiling hydrochloric acid (HCl) and boiling hydrofluoric acid (HF) as leaching agents. One particularly suitable leaching agent is hydrochloric acid (HCl) at a temperature of above 110° C., which may be provided in contact with exposed surfaces of the first region 106 of the polycrystalline table 102 for a period of about 2 hours to about 60 hours, depending upon the size of the polycrystalline table 102. Surfaces of the cutting element 100, as shown in any of FIGS. 1 through 6, other than those to be leached, such as surfaces of the substrate 104, and/or exposed lateral surfaces of the second region 108 of the polycrystalline table 102, may be covered (e.g., coated) with a protective material, such as a polymer material, that is resistant to etching or other damage from the leaching agent. The surfaces to be leached then may be exposed to and brought into contact with the leaching fluid by, for example, dipping or immersing at least a portion of the first region 106 of the polycrystalline table 102 of the cutting element 100 into the leaching fluid.

The leaching agent will penetrate into the first region 106 of the polycrystalline compact 102 of the cutting element 100 from the exposed surfaces thereof. The depth or distances into the first region 106 of the polycrystalline table 102 from the exposed surfaces reached by the leaching fluid will be a function of the time to which the first region 106 is exposed to the leaching fluid (i.e., the leaching time) and the rate at which the leaching agent penetrates through the microstructure of the first region 106. The rate of flow of the leaching fluid through the second region 108 of the polycrystalline table 102 during the leaching process may be relatively lower than the flow rate through the first region 106 due to the reduced permeability of the second region 108. In other words, the interface 112 between the first and second regions 106 and 108 may serve as a barrier to hinder or impede the flow of leaching fluid further into the polycrystalline table 102, and specifically, into the second region 108 of the polycrystalline table 102. As a result, once the leaching fluid reaches the interface 112 (FIGS. 1 through 6) between the first region 106 and the second region 108, the rate at which the leaching depth increases as a function of time may be reduced to a significant extent. Thus, a specific desirable depth at which it is desired to leach catalyst material 130 from the polycrystalline table 102 may be selected and defined by positioning the interface 112 between the first region 106 and the second region 108 at a desirable, selected depth or location within the polycrystalline table 102. The interface 112 may be used to hinder or impede the flow of leaching fluid, and, hence, leaching of catalyst material 130 out from the polycrystalline table 102, beyond a desirable, selected leaching depth, at which the interface 112 is positioned. Stated another way, the flow of the leaching fluid through the second region 108 of the polycrystalline table 102 among the grains 138 and 140 may be impeded using the smaller grains 140 of superabrasive material in the second region 108 of the polycrystalline table 102 as a barrier to the leaching fluid.

Once the leaching fluid reaches the interface 112, continued exposure to the leaching fluid may cause further leaching of catalyst material 130 from the second region 108 of the polycrystalline table 102, although at a slower leaching rate than that at which catalyst material 130 is leached out from the first region 106 of the polycrystalline table 102. Leaching catalyst material 130 out from the second region 108 may be undesirable, and the duration of the leaching process may be selected such that catalyst material 130 is not leached from the second region 108 in any significant quantity (i.e., in any quantity that would measurably alter the strength or fracture toughness of the polycrystalline table 102).

Thus, catalyst material 130 may be leached out from the interstitial spaces within the first region 106 of the polycrystalline table 102 using a leaching fluid without entirely removing catalyst material 130 from the interstitial spaces within the second region 108 of the polycrystalline table 102. In some embodiments, the catalyst material 130 may remain within at least substantially all (e.g., within about 98% by volume or more) of the interstitial spaces within the second region 108 of the polycrystalline table 102. By contrast, the catalyst material 130 may be substantially fully removed from the first region 106 of the polycrystalline table 102. As shown in FIG. 13, the interstitial spaces among the interbonded grains 142 within the first region 106 may comprise voids 144 after the leaching process. The voids 144 may be filled with environmental fluid (e.g., air) and be substantially completely free of catalyst material 130.

Figure 14:
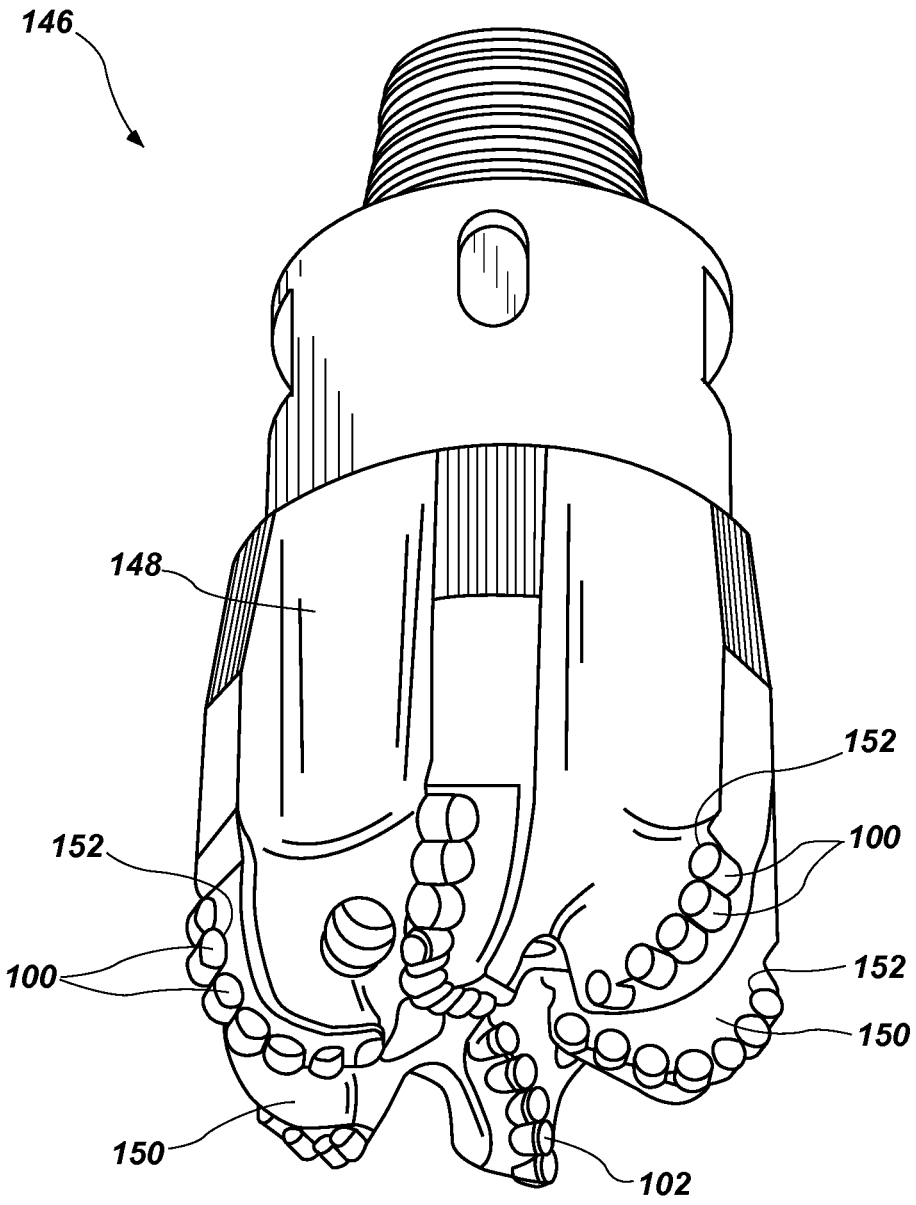
FIG. 14 is a perspective view of an earth-boring drill bit having cutting elements attached thereto, at least one cutting element having a polycrystalline table of the present disclosure.

Referring to FIG. 14, a perspective view of an earth-boring drill bit 146 having cutting elements 100, such as any of the cutting elements described previously in connection with FIGS. 1 through 7F, attached thereto, at least one cutting element having a polycrystalline table 102 of the present disclosure. The earth-boring drill bit 146 includes a bit body 148 having blades 150 extending from the bit body 148. The cutting elements 100 may be secured within pockets 152 formed in the blades 150. However, cutting elements 100 and polycrystalline tables 102 as described herein may be bonded to and used on other types of earth-boring tools, including, for example, roller cone drill bits, percussion bits, core bits, eccentric bits, bicenter bits, reamers, expandable reamers, mills, hybrid bits, and other drilling bits and tools known in the art.

The foregoing description is directed to particular embodiments for the purpose of illustration and explanation. It will be apparent, however, to one skilled in the art that many additions, deletions, modifications, and changes to the embodiments set forth above are possible without departing from the scope of the embodiments disclosed herein as hereinafter claimed, including legal equivalents. It is intended that the following claims be interpreted to embrace all such modifications and changes.

What is claimed is:

1. A polycrystalline element, comprising:

a substrate; and a polycrystalline table attached to an end of the substrate and comprising a first region of superabrasive material having a first permeability and at least a second region of superabrasive material having a second, lesser permeability, the at least a second region being interposed between the substrate and the first region, wherein the first region comprises a first volume percentage of interstitial volumes among interbonded grains of superabrasive material and the at least a second region comprises a second, smaller volume percentage of interstitial volumes among interbonded grains of superabrasive material.

2. The polycrystalline element of claim 1, wherein the first region is at least substantially fully leached of catalyst material.

3. The polycrystalline element of claim 1, wherein an interface between the first and at least a second regions of the polycrystalline table comprises a non-planar interface.

4. The polycrystalline element of claim 1, wherein the polycrystalline table further comprises a third region disposed adjacent the at least a second region on an end opposing the first region.

5. The polycrystalline element of claim 1, wherein the first region comprises a first volume percentage of superabrasive material and the at least a second region comprises a second, greater volume percentage of superabrasive material.

6. The polycrystalline element of claim 1, wherein the first region comprises a first mean grain size of grains of superabrasive material and the at least a second region comprises a second, smaller mean grain size of grains of superabrasive material.

7. The polycrystalline element of claim 6, wherein the at least a second region comprises at least some nano-sized grains.

8. The polycrystalline element of claim 1, wherein the first region comprises interstitial volumes having a first interconnectivity and the at least a second region comprises interstitial volumes having a second, lesser interconnectivity.

9. A method of forming a polycrystalline element, comprising:

disposing a first plurality of particles comprising a superabrasive material, a second plurality of particles comprising a superabrasive material, a catalyst material, and a third plurality of particles comprising a mass of hard material in a mold;

sintering the first and second pluralities of particles in the presence of the catalyst material and the third plurality of particles to form a polycrystalline table attached to a substrate, the polycrystalline table having a first region comprising a first volume percentage of interstitial volumes among interbonded grains of superabrasive material and at least a second region comprising a second, smaller volume percentage of interstitial volumes among interbonded grains of superabrasive material, the first region exhibiting a first permeability and the at least a second region exhibiting a second, lesser permeability, the at least a second region being interposed between the first region and the substrate; and removing catalyst material from at least the first region of the polycrystalline table.

10. The method of claim 9, further comprising:

pressing the second plurality of particles to form a green part prior to disposing the second plurality of particles in the mold.

11. The method of claim 10, wherein pressing the second plurality of particles to form a green part prior to disposing the second plurality of particles in the mold comprises imparting a non-planar interface design to the green part.

12. The method of claim 9, further comprising:

disposing a fourth plurality of particles comprising a non-catalyst material removable by a leaching agent dispersed among the first plurality of particles in the mold.

13. The method of claim 9, further comprising:

disposing a fourth plurality of particles comprising a non-catalyst material removable by a leaching agent among the first plurality of particles.

14. The method of claim 9, wherein disposing a first plurality of particles comprising a superabrasive material, a second plurality of particles comprising the superabrasive material, a catalyst material, and a third plurality of particles comprising a mass of hard material in a mold comprises disposing the first plurality of particles having a first packing density and the second plurality of particles having a second, greater packing density in the mold.

15. The method of claim 9, wherein disposing a first plurality of particles comprising a superabrasive material, a second plurality of particles comprising the superabrasive material, a catalyst material, and a third plurality of particles comprising a mass of hard material in a mold comprises disposing the first plurality of particles having a first mean particle size and the second plurality of particles having a second, smaller mean particle size in the mold.

16. The method of claim 15, wherein disposing the first plurality of particles having a first mean particle size and the second plurality of particles having a second, smaller mean particle size in the mold comprises disposing the second plurality of particles comprising at least some nanoparticles in the mold.

17. The method of claim 9, further comprising:

coating at least some of the first plurality of particles with the catalyst material using chemical solution deposition prior to disposing the first plurality of particles in the mold.

18. The method of claim 9, wherein sintering the first and second pluralities of particles in the presence of the catalyst material and the third plurality of particles to form a polycrystalline table having a first region comprising a first permeability and at least a second region comprising a second, lesser permeability attached to a substrate comprises sintering the first and at least a second pluralities of particles in the presence of the catalyst material and the third plurality of particles to form a polycrystalline table having a first region comprising a first volume percentage of catalyst material disposed in interstitial spaces among interbonded grains of superabrasive material and at least a second region comprising a second, smaller volume percentage of catalyst material disposed in interstitial spaces among interbonded grains of superabrasive material.

19. A method of forming a polycrystalline element, comprising:

attaching a polycrystalline table to an end of a substrate, the polycrystalline table comprising a first region comprising a first volume percentage of interstitial volumes among interbonded grains of superabrasive material and at least a second region comprising a second, smaller volume percentage of interstitial volumes among interbonded grains of superabrasive material, the first region of exhibiting a first permeability and the at least a second region exhibiting a second, lesser permeability, the at least a second region being interposed between the first region and the substrate; and removing catalyst material from at least the first region of the polycrystalline table.

20. A method of forming a polycrystalline element, comprising:

forming a first polycrystalline table of superabrasive material in the presence of a catalyst material, the first polycrystalline table having a first region having a first volume percentage of interstitial volumes among interbonded grains of superabrasive material, the first region exhibiting a first permeability, and a second region having a second, smaller volume percentage of interstitial volumes among interbonded grains of superabrasive material, the second region exhibiting a second, lower permeability;

at least substantially fully leaching the catalyst material from at least the first region of the first polycrystalline table; and bonding the first polycrystalline table to another polycrystalline table of superabrasive material attached to an end of a substrate of hard material, the second region being interposed between the first region and the other polycrystalline table.

* * * * *